US011819811B2

(12) United States Patent
Miura et al.

(10) Patent No.: US 11,819,811 B2
(45) Date of Patent: Nov. 21, 2023

(54) PREMIXING DEVICE AND COMBUSTION DEVICE EQUIPPED WITH THE PREMIXING DEVICE

(71) Applicant: NORITZ CORPORATION, Hyogo (JP)

(72) Inventors: Keiichi Miura, Hyogo (JP); Tsuneo Funabiki, Hyogo (JP); Tatsuya Karaki, Hyogo (JP); Kyohei Ogawa, Hyogo (JP)

(73) Assignee: NORITZ CORPORATION, Hyogo (JP)

( * ) Notice: Subject to any disclaimer, the term of this patent is extended or adjusted under 35 U.S.C. 154(b) by 0 days.

(21) Appl. No.: 17/348,774

(22) Filed: Jun. 16, 2021

(65) Prior Publication Data

US 2021/0394134 A1 Dec. 23, 2021

(30) Foreign Application Priority Data

Jun. 23, 2020 (JP) ..... 2020-107687
Jun. 23, 2020 (JP) ..... 2020-107690

(51) Int. Cl.
*B01F 25/312* (2022.01)
*B01F 23/10* (2022.01)
(Continued)

(52) U.S. Cl.
CPC ..... *B01F 25/312* (2022.01); *B01F 23/10* (2022.01); *B01F 25/31242* (2022.01);
(Continued)

(58) Field of Classification Search
CPC ..... B01F 25/312; B01F 25/312512; B01F 25/312522; B01F 25/31242; B01F 23/10;
(Continued)

(56) References Cited

U.S. PATENT DOCUMENTS 3,489,396 A * 1/1970 Aragon ..... B01F 25/312 210/220
3,636,765 A * 1/1972 Brown ..... G01F 1/44 73/861.64

(Continued)

FOREIGN PATENT DOCUMENTS

JP H11502278 2/1999
WO WO-9629511 A1 * 9/1996 ..... F02B 43/00

*Primary Examiner* — Matthew W Jellett
*Assistant Examiner* — Christopher D Ballman
(74) *Attorney, Agent, or Firm* — JCIPRNET

(57) ABSTRACT

A premixing device includes: a gas flow passage forming member in which an x direction is used as an axial length direction, and a Venturi-shaped gas flow passage into which air can flow in from the outside is formed inside; and a blade portion positioned in the gas flow passage, extending in a y direction, and equipped with a fuel gas outlet. The blade portion includes first and second blade portions spaced apart from each other in a z direction, and an air flow path near the center through which a part of the air flows is formed between these first and second blade portions. At least one of a pair of surfaces of the first and second blade portions facing each other is equipped with an inner bulging portion that bulges in the z direction so as to squeeze a part of the air flow path near the center.

11 Claims, 5 Drawing Sheets

(51) Int. Cl.

| | |
|---|---|
| *B01F 101/00* | (2022.01) |
| *F23D 14/02* | (2006.01) |
| *F23D 14/70* | (2006.01) |
| *F23D 14/62* | (2006.01) |

(52) U.S. Cl.
CPC ..... *B01F 25/312512* (2022.01); *B01F 25/312522* (2022.01); *B01F 2101/503* (2022.01); *F23D 14/02* (2013.01); *F23D 14/62* (2013.01); *F23D 14/70* (2013.01); *F23D 2203/007* (2013.01); *F23D 2203/105* (2013.01)

(58) Field of Classification Search
CPC ..... B01F 2101/503; F23D 2203/105; F23D 2203/007; F23D 14/02; F23D 14/62; F23D 14/70
See application file for complete search history.

(56) References Cited

U.S. PATENT DOCUMENTS 3,736,797 A * 6/1973 Brown ..... G01F 1/44 73/861.64
4,117,048 A * 9/1978 Stockner ..... B01F 25/312 261/87
4,416,610 A * 11/1983 Gallagher, Jr. ..... B01F 25/312 137/888
4,845,952 A * 7/1989 Beebe ..... F23R 3/34 60/737
4,991,561 A * 2/1991 Gerassimov ..... F02M 21/042 123/527
7,104,750 B2 * 9/2006 Bolis ..... F02C 3/30 415/117
8,939,129 B2 * 1/2015 Prinz ..... F02M 21/047 123/518
9,635,922 B2 * 5/2017 Logsdon ..... A45D 20/12
2005/0161028 A1 * 7/2005 Wolters ..... F02M 21/042 137/896
2012/0160333 A1 * 6/2012 West ..... C02F 1/74 261/74
2013/0068852 A1 * 3/2013 Wurz ..... F04F 5/463 239/10
2015/0007900 A1 * 1/2015 Li ..... F23D 14/04 137/892
2015/0086934 A1 * 3/2015 Akbarimonfared ..... F23D 14/70 432/29
2016/0354732 A1 * 12/2016 Mok ..... B01F 25/31242
2018/0058388 A1 * 3/2018 Zhang ..... B01F 25/31232
2018/0078895 A1 * 3/2018 Pease ..... B01D 53/1462
2018/0266678 A1 * 9/2018 Feese ..... F23D 14/62
2019/0093879 A1 * 3/2019 Pisani ..... F23D 14/02

* cited by examiner

PREMIXING DEVICE AND COMBUSTION DEVICE EQUIPPED WITH THE PREMIXING DEVICE

CROSS-REFERENCE TO RELATED APPLICATION

This application claims the priority benefit of Japan application serial no. 2020-107687, filed on Jun. 23, 2020 and Japan application serial no. 2020-107690, filed on Jun. 23, 2020. The entirety of each of the above-mentioned patent applications is hereby incorporated by reference herein and made a part of this specification.

BACKGROUND OF THE INVENTION

Field of the Invention

The disclosure relates to a premixing device and a combustion device equipped with the premixing device.

Here, the "premixing" is a process of mixing air and fuel gas to generate a combustible mixed gas for the purpose of performing premixing combustion.

Description of the Related Art

A specific example of the premixing device is described in Patent literature 1, which is shown in FIGS. 9A and 9B.

A premixing device Ae shown in FIGS. 9A and 9B includes a tubular member 4*e* having a Venturi-shaped gas flow passage 40 formed inside, and a vertical blade portion 9A and a horizontal blade portion 9B attached to the tubular member 4*e*. An intake side of a fan (not shown) is connected to a downstream side of the gas flow passage 40 (the right side in FIG. 9A), and air flows into the gas flow passage 40. The gas flow passage 40 has a Venturi shape, to which a part is connected where a flow path area of an upstream region thereof gradually decreases while a flow path area of a downstream region gradually increases. As shown in FIG. 9B, the two vertical and horizontal blade portions 9A and 9B are arranged in a state of being connected in a cross shape in a side view, and a fuel gas outlet 60 is arranged at a rear end portion on the downstream side in these gas flow directions. The blade portions 9A and 9B have an internal hollow shape, and fuel gas is supplied into the blade portions 9A and 9B from the periphery of the tubular member 4*e*.

In the premixing device Ae, air flows through the gas flow passage 40 and a negative pressure is generated near the fuel gas outlet 60. Thereby, fuel gas flows out from the fuel gas outlet 60 to the gas flow passage 40 and is mixed with air. Because the gas flow passage 40 has the Venturi shape, flow velocity of air can be increased and the negative pressure can be generated.

However, in the prior art, there is room for improvement as described below.

Generally, required performances of the premixing device include reducing pressure loss of the gas, obtaining a high turndown ratio, and the like.

Here, although the premixing device Ae can appropriately generate a negative pressure for fuel gas outflow and mix fuel gas and air at a certain ratio or more when the air flow rate in the gas flow passage 40 is large, when the air flow rate is small, the above-mentioned negative pressure is not generated in a sufficient state, and it is less likely for fuel gas to flow out from the fuel gas outlet 60 by an appropriate amount to mix with air. Thus, it is desirable to improve this situation as much as possible, and thereby a high turndown ratio can be obtained.

LITERATURE OF RELATED ART

Patent Literature

[Patent literature 1] National Publication of Japanese Patent Application No. 11-502278

SUMMERY

The following technical measures are taken in the disclosure.

A premixing device provided by a first aspect of the disclosure includes: a gas flow passage forming member in which an x direction among x, y, and z directions that intersect each other is used as an axial length direction, and a Venturi-shaped gas flow passage into which air can flow in from an outside is formed inside the gas flow passage forming member; a blade portion positioned in the gas flow passage and extending in the y direction; and a fuel gas outlet that is arranged in the blade portion, and is used for allowing fuel gas to flow out into the gas flow passage by an action of a negative pressure generated when air flowing into the gas flow passage passes through a periphery of the blade portion and mixing the fuel gas with the air. The blade portion includes first and second blade portions that are spaced apart from each other in the z direction, and an air flow path near a center of the gas flow passage through which a part of the air flows is formed between these first and second blade portions. At least one of a pair of surfaces of the first and second blade portions facing each other is equipped with an inner bulging portion that bulges in the z direction so as to squeeze a part of the air flow path near the center of the gas flow passage.

According to an embodiment of the present disclosure, the Venturi-shaped gas flow passage includes an opening portion for air inflow, an upstream tapered region that has an inner diameter gradually decreasing toward a rear side of the upstream tapered region, a small-diameter portion that is connected to the rear side of the upstream tapered region and has a minimum inner diameter, and a downstream tapered region that is connected to a rear side of the small-diameter portion and has an inner diameter gradually expanding toward a rear side of the downstream tapered region. The inner bulging portion is positioned in the small-diameter portion.

A premixing device provided by a second aspect of the disclosure includes: a gas flow passage forming member in which an x direction among x, y, and z directions that intersect each other is used as an axial length direction, and a Venturi-shaped gas flow passage into which air can flow in from an outside is formed inside the gas flow passage forming member; a blade portion positioned in the gas flow passage and extending in the y direction; and a fuel gas outlet that is arranged in the blade portion, and is used for allowing fuel gas to flow out into the gas flow passage by an action of a negative pressure generated when air flowing into the gas flow passage passes through a periphery of the blade portion and mixing the fuel gas with the air. The blade portion includes first and second blade portions that are spaced apart from each other in the z direction, and a pair of air flow paths near ends of the gas flow passage through which a part of the air flows is formed between the first and second blade portion and an inner wall surface of the gas flow passage. Each surface of the first and second blade portions that faces the inner wall surface is equipped with an outer bulging portion that bulges in the z direction so as to squeeze a part of each of the pair of air flow paths near the ends of the gas flow passage.

According to an embodiment of the present disclosure, the Venturi-shaped gas flow passage includes an opening portion for air inflow, an upstream tapered region that has an inner diameter gradually decreasing toward a rear side of the upstream tapered region, a small-diameter portion that is connected to the rear side of the upstream tapered region and has a minimum inner diameter, and a downstream tapered region that is connected to a rear side of the small-diameter portion and has an inner diameter gradually expanding toward a rear side of the downstream tapered region. The outer bulging portion is positioned in the small-diameter portion.

According to an embodiment of the present disclosure, a flow path area of a location of each of the pair of air flow paths near the ends of the gas flow passage squeezed by the outer bulging portion and a flow path area of a location of the air flow path near the center of the gas flow passage squeezed by the inner bulging portion are substantially the same.

According to an embodiment of the present disclosure, the first and second blade portions respectively include: a pair of front inclined surfaces that is arranged in a region near a front on an upstream side in a gas flow direction, inclines in a backward expanding manner so that a blade thickness increases toward a downstream side in the gas flow direction, and the pair of front inclined surfaces has an acute intersection angle; and a pair of rear inclined surfaces that is arranged on a rear side of the pair of front inclined surfaces, inclines in a backward narrowing manner so that a blade thickness decreases toward the downstream side in the gas flow direction, and has an inclination angle smaller than the inclination angle of the pair of front inclined surfaces. A boundary part between the pair of front inclined surfaces and the pair of rear inclined surfaces is a location having a maximum blade thickness, a part of the boundary part is the inner bulging portion, and the other part of the boundary part is the outer bulging portion.

According to an embodiment of the present disclosure, each rear end portion of the first and second blade portions is equipped with a concave portion that is partially recessed toward an upstream side in a gas flow direction, and the fuel gas outlet is arranged in the concave portion.

A combustion device provided by a third aspect of the disclosure includes the premixing device provided by the first aspect or the second aspect of the disclosure.

Other features and advantages of the disclosure will become more apparent from the following description of an embodiment of the invention with reference to the accompanying drawings.

DETAILED DESCRIPTION OF THE EMBODIMENTS

The disclosure provides a premixing device which can reduce pressure loss and obtain a high turndown ratio, and a combustion device equipped with the premixing device.

Hereinafter, an embodiment of the disclosure is specifically described with reference to the drawings.

Figure 9A:
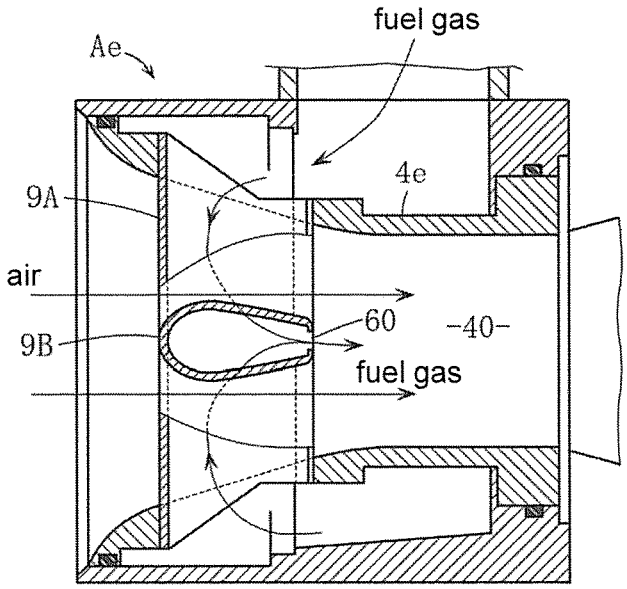
FIG. 9A (RELATED ART)
FIG. 9A is a cross-sectional view of a main part showing an example of the prior art.
Figure 9B:
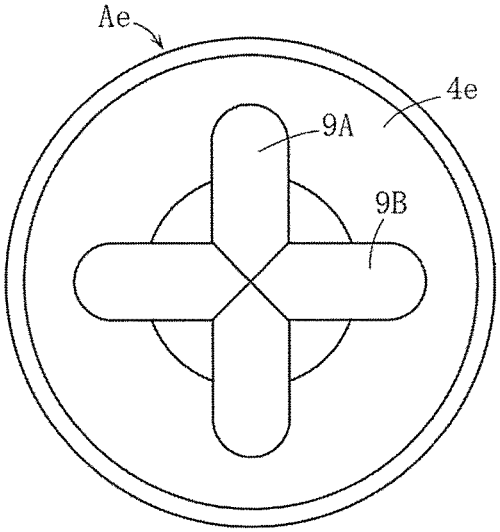
FIG. 9B (RELATED ART)
FIG. 9B is a left side view of the main part of FIG. 9A.

Elements that are the same as or similar to those of the prior art shown in FIGS. 9A and 9B are appropriately designated by the same reference numerals as those of the prior art.

Figure 1:
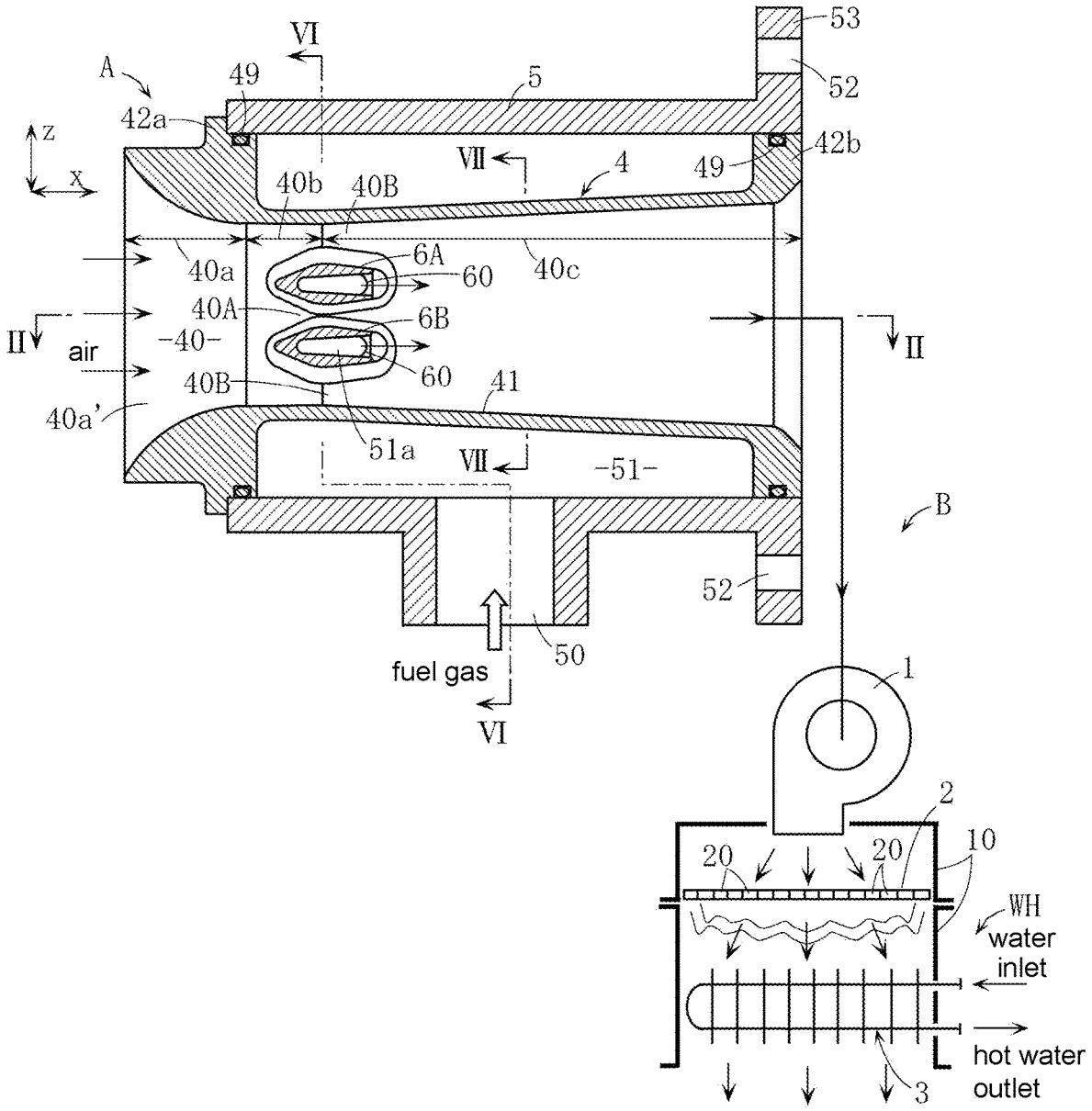
FIG. 1 is an illustrative diagram showing an example of a combustion device equipped with a premixing device according to the disclosure and a hot water supply device using the combustion device.
Figure 2:
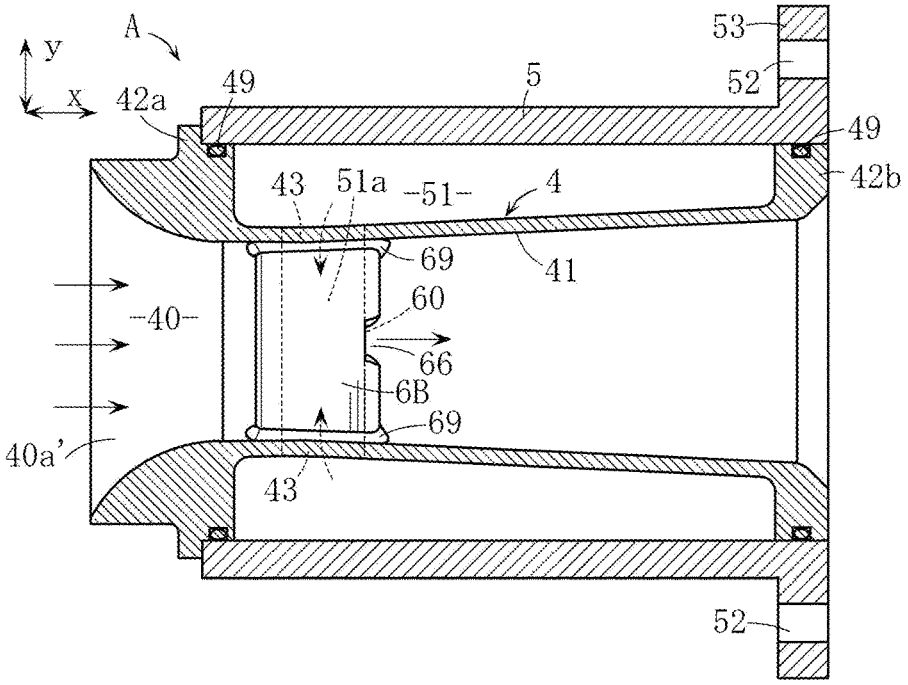
FIG. 2 is a cross-sectional view taken along a line II-II of FIG. 1.
Figure 3:
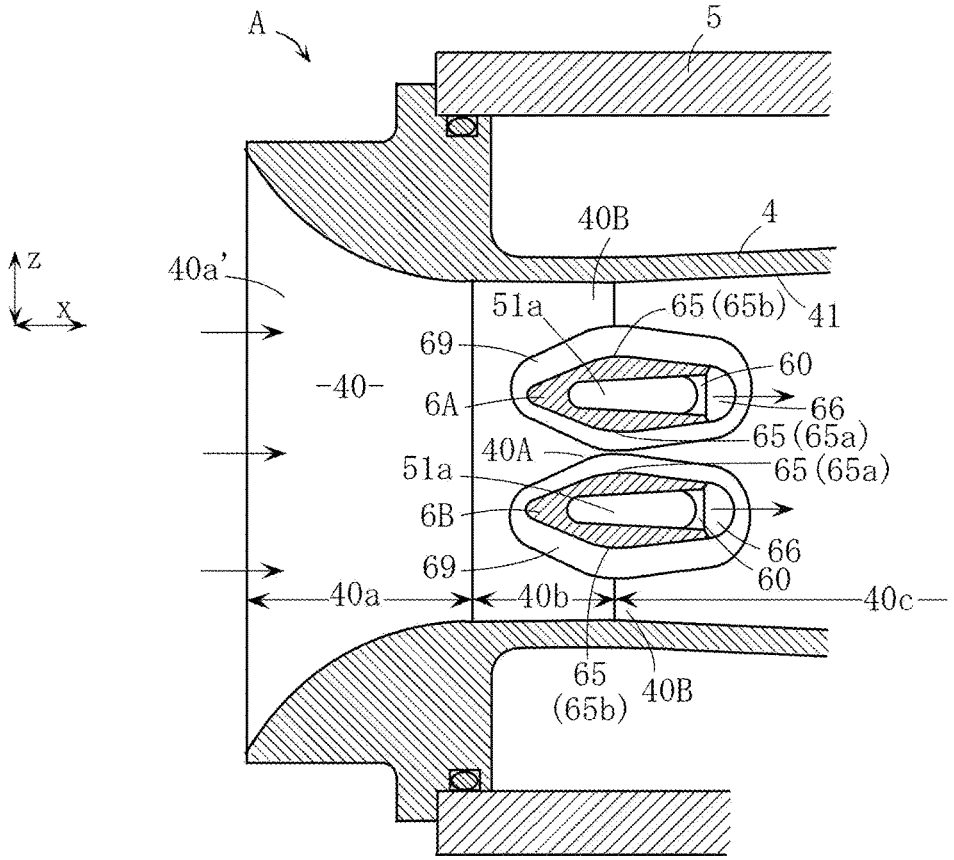
FIG. 3 is an enlarged view of a main part of FIG. 1.

FIG. 1 shows a premixing device A, a combustion device B (premixing combustion device) configured by combining a fan 1 and a combustion plate 2 with the premixing device A, and a hot water supply device WH configured by combining a heat exchanger 3 with the combustion device B. In the embodiment, x and y directions shown in the drawings are both horizontal directions and intersect with each other. A z direction is a vertical height direction.

Details of the premixing device A are described later, and the premixing device A is used to generate mixed gas (combustible mixed gas) of air and fuel gas. This mixed gas is discharged toward the combustion plate 2 via the fan 1. The combustion plate 2 is a porous plate having a plurality of ventilation holes 20 and is accommodated in a case 10. The mixed gas passes through the combustion plate 2 and burns below the combustion plate 2. Combustion gas generated thereby acts in the heat exchanger 3, and water flowing through the inside of the heat exchanger 3 is heated to generate hot water. The hot water is supplied to a desired hot water supply destination.

The premixing device A includes a tubular member 4 connected to an intake port of the fan 1, a housing member 5 surrounding the tubular member 4, and a first blade portion 6A and a second blade portion 6B.

The tubular member 4 is a member in which a venturi-shaped gas flow passage 40 (corresponding to a premixing chamber) is formed inside, and corresponds to an example of a gas flow passage forming member in the disclosure. An axial length direction of the tubular member 4 is the x direction. When the fan 1 is driven, external air flows into the gas flow passage 40. The gas flow passage 40 includes an opening portion 40*a*' for air inflow and has a configuration in which an upstream tapered region 40*a* having a gradually decreasing inner diameter, a small-diameter portion 40*b* having the smallest and substantially constant inner diameter, and a downstream tapered region 40*c* having a gradually expanding inner diameter are formed from the upstream side to the downstream side in the gas flow direction (air flow direction). However, unlike the embodiment, a width (a width in the x direction) of the small-diameter portion 40*b* can also be set to zero or close to zero (a configuration is also possible in which a front end of the downstream tapered region 40*c* is directly connected to a rear end of the upstream tapered region 40*a*, and a boundary between these regions 40*a* and 40*c* is the small-diameter portion 40*b*).

The first blade portion 6A and the second blade portion 6B serve as nozzles for allowing fuel gas to flow out into the gas flow passage 40, and additionally, the first blade portion 6A and the second blade portion 6B also serve to control the air flow in the gas flow passage 40 to be suitable for the outflow of fuel gas. The first blade portion 6A and the second blade portion 6B have an internal hollow shape equipped with an internal space portion 51*a* serving as a fuel gas flow passage and a fuel gas outlet 60. The first blade portion 6A and the second blade portion 6B are positioned in the gas flow passage 40 in a state of being bridged to an inner wall surface 41 of the gas flow passage 40 (an inner surface of a peripheral wall portion of the tubular member 4), and extend in the y direction (see also FIGS. 2, 5 to 7).

According to an embodiment, rounded portions 69 for suppressing a sudden change in shape are arranged at connection portions between both ends of the first blade portion 6A and the second blade portion 6B and the inner wall surface 41 of the gas flow passage 40. The rounded portion 69 can bring about an effect of suppressing the air flow from becoming turbulent.

Figure 5:
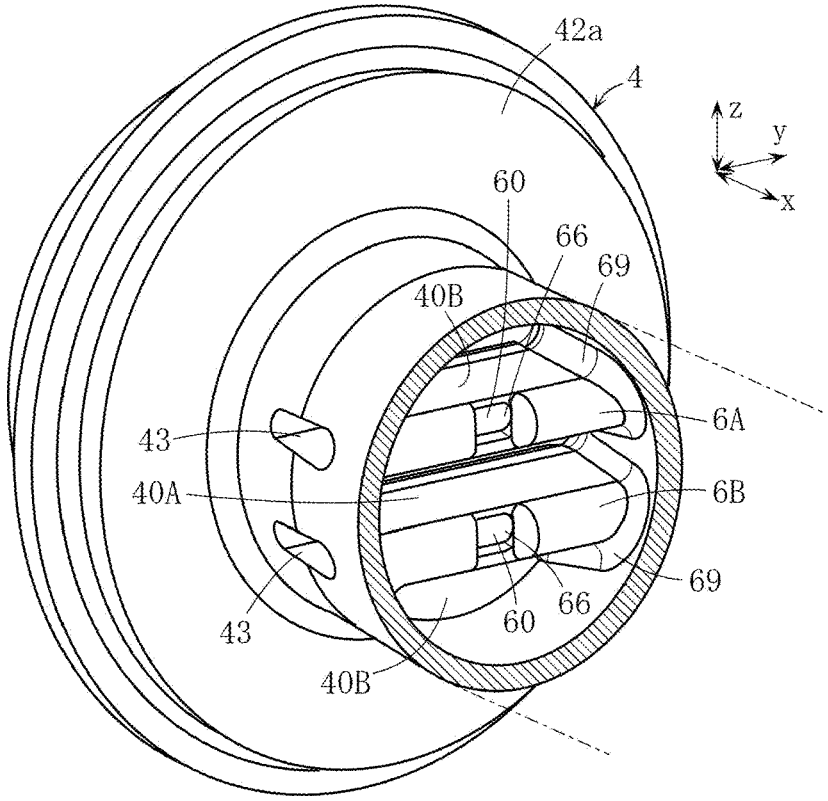
FIG. 5 is a schematic perspective view of a partial broken main part of a tubular member of the premixing device shown in FIG. 1.
Figure 6:
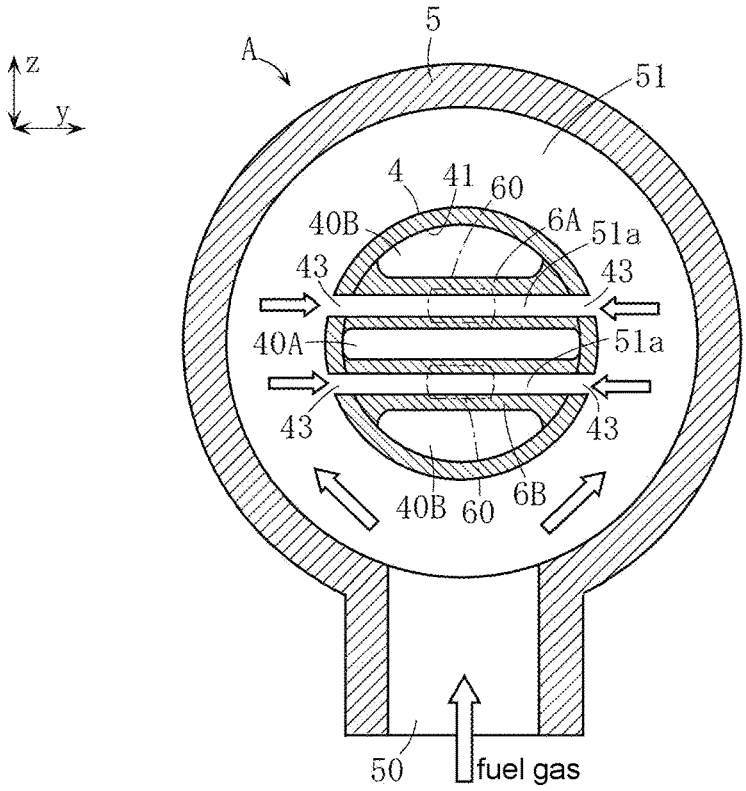
FIG. 6 is a cross-sectional view taken along a line VI-VI of FIG. 1.

The housing member 5 serves as a fuel gas supply member to the first blade portion 6A and the second blade portion 6B. More specifically, the housing member 5 is fitted onto stepped portions 42*a* and 42*b* arranged on front and rear portions of the outer periphery of the tubular member 4, and surrounds the tubular member 4 in a state where hermetic sealing is achieved by a sealing ring 49. The housing member 5 is equipped with a fuel gas supply port 50, and fuel gas supplied to the fuel gas supply port 50 is supplied to a fuel gas supply path 51 formed between the tubular member 4 and the housing member 5. On the other hand, as shown in FIGS. 5 and 6, the tubular member 4 is formed with an opening portion 43 communicating with the internal space portions 51*a* of the first blade portion 6A and the second blade portion 6B. The fuel gas supplied to the fuel gas supply path 51 passes through the opening portion 43, flows into the internal space portions 51*a* of the first blade portion 6A and the second blade portion 6B, and then flows out from the fuel gas outlet 60 into the gas flow passage 40. According to an embodiment, the housing member 5 is equipped with a flange portion 53 including a bolt insertion hole 52. According to this configuration, the premixing device A can be easily and appropriately connected to a desired site by using the flange portion 53.

The first blade portion 6A and the second blade portion 6B are arranged substantially parallel to each other with an interval in the vertical height direction (the z direction). Thereby, an air flow path near the center 40A is formed between the first blade portion 6A and the second blade portion 6B. A pair of upper and lower air flow paths near the end 40B is formed, wherein the upper air flow path near the end 40B is formed between the first blade portion 6A and an upper portion of the inner wall surface 41, and the lower air flow path near the end 40B is formed between the second blade portion 6B and a lower portion of the inner wall surface 41.

Figure 4:
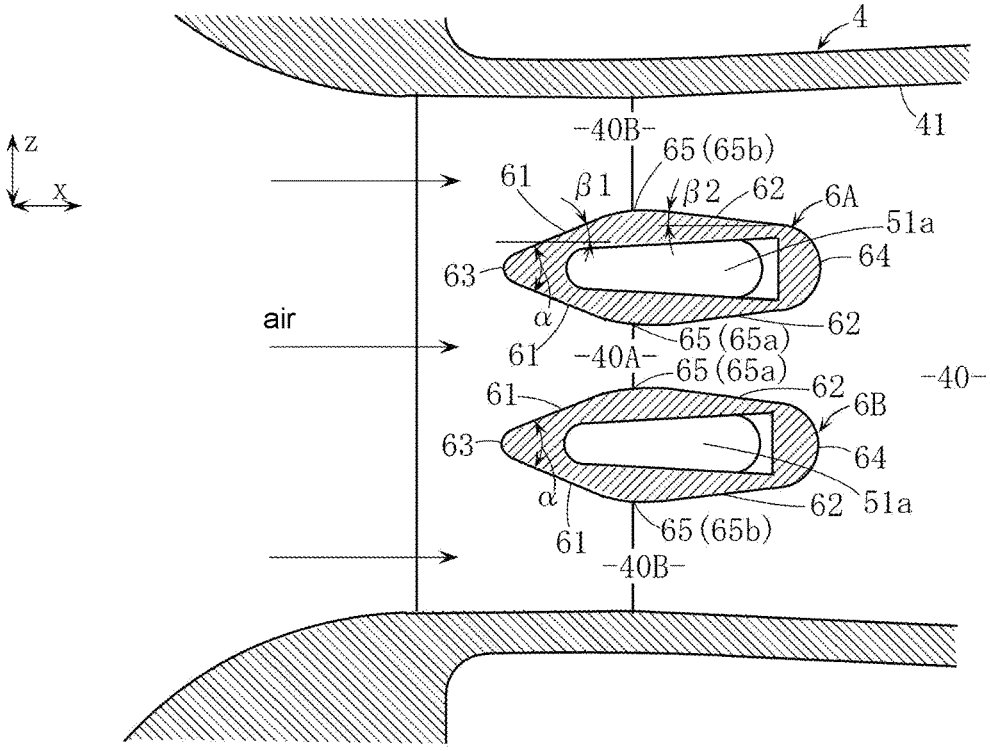
FIG. 4 is a cross-sectional view of a location of first and second blade portions of FIG. 2 in which a fuel gas outlet is not formed (illustration of rounded portions at the ends of the first and second blade portions is omitted).

In the embodiment, the first blade portion 6A and the second blade portion 6B are aligned identically in shape and size, and the location where the fuel gas outlet 60 is not formed has a cross-sectional shape as shown in FIG. 4.

That is, in FIG. 4, each of the first blade portion 6A and the second blade portion 6B has a pair of front inclined surfaces 61 in a region near the front on the upstream side in the gas flow direction, and a pair of rear inclined surfaces 62 on the rear side of the front inclined surfaces 61. The pair of front inclined surfaces 61 inclines in a backward expanding manner so that a blade thickness increases toward the downstream side in the gas flow direction, and has an acute intersection angle $\alpha$ therebetween. On the other hand, the pair of rear inclined surfaces 62 inclines in a backward narrowing manner so that a blade thickness decreases toward the downstream side in the gas flow direction, and has an inclination angle $\beta 2$ with respect to the horizontal direction (the x direction) smaller than an inclination angle $\beta 1$ ($\beta 1=\alpha/2$) of each front inclined surface 61. Front end surfaces 63 of the first blade portion 6A and the second blade portion 6B are curved surfaces that smoothly connect front parts of the pair of front inclined surfaces 61 that are close to each other. Rear end surfaces 64 of the first blade portion 6A and the second blade portion 6B are curved surfaces that smoothly connect rear end portions of the pair of rear inclined surfaces 62.

In the first blade portion 6A and the second blade portion 6B, boundary parts between the pair of front inclined surfaces 61 and the pair of rear inclined surfaces 62 are a plurality of bulging portions 65 that partially bulges upward and downward with respect to front end portions and rear end portions of the first blade portion 6A and the second blade portion 6B, and the boundary parts are locations having the maximum blade thicknesses.

The plurality of bulging portions 65 includes a pair of inner bulging portions 65*a* and a pair of outer bulging portions 65*b*. The pair of inner bulging portions 65*a* is upward or downward bulging portions arranged on surfaces of the first blade portion 6A and the second blade portion 6B facing each other, and squeezes a part of the air flow path near the center 40A. That is, the air flow path near the center 40A has a configuration in which a region sandwiched by the pair of inner bulging portions 65*a* is partially squeezed as a region having a smaller area than an upstream region and a downstream region thereof.

The pair of outer bulging portions 65*b* is upward or downward bulging portions arranged on surfaces of the first blade portion 6A and the second blade portion 6B facing the inner wall surface 41, and squeezes a part of each of the pair of air flow paths near the end 40B. That is, each of the pair of air flow paths near the end 40B has a configuration in which a region facing the outer bulging portion 65*b* is partially squeezed as a region having a smaller area than an upstream region and a downstream region thereof.

The inner bulging portion 65*a* and the outer bulging portion 65*b* are positioned in the small-diameter portion 40*b* having the smallest inner diameter in the gas flow passage 40. According to an embodiment, at the location where the inner bulging portion 65*a* and the outer bulging portion 65*b* are arranged, a flow path area A1 of the air flow path near the center 40A and flow path areas A2 (A2*a* and A2*b*) of the pair of air flow paths near the end 40B shown in FIG. 7 have a relationship of A1≈A2 (A1≈A2*a*≈A2*b*).

The fuel gas outlet 60 is arranged at a rear end portion of a central portion of each of the first blade portion 6A and the second blade portion 6B in the longitudinal direction (the y direction). However, in the embodiment, the rear end portions of the first blade portion 6A and the second blade portion 6B are equipped with concave portions 66 partially recessed toward the upstream side in the gas flow direction, and the fuel gas outlet 60 is arranged at the back (upstream side) of the concave portion 66. As described later, this configuration can bring about an effect that the fuel gas outflow is less likely to be adversely affected when an air vortex is generated on the downstream side in the gas flow direction of the first blade portion 6A and the second blade portion 6B. The fuel gas outlet 60 is opened toward the downstream side in the gas flow direction, and thus pressure loss due to the fuel gas outflow from the fuel gas outlet 60 is prevented as much as possible.

Next, actions of the premixing device A and the combustion device B described above are described.

First, when the fan 1 is driven, air flows into the gas flow passage 40 from the opening portion 40*a*', and passes through the air flow path near the center 40A and the pair of air flow paths near the end 40B. Here, because the gas flow passage 40 has a Venturi shape having the small-diameter portion 40*b*, the flow velocity of air is increased in the small-diameter portion 40*b*. In addition, because the air flow path near the center 40A is squeezed by the pair of inner bulging portions 65*a* of the first blade portion 6A and the second blade portion 6B as described above, the flow velocity of air is further increased in this part. Because each air flow path near the end 40B is also squeezed by the outer bulging portions 65*b* of the first blade portion 6A and the second blade portion 6B, the flow velocity of air is also further increased in this part.

For this reason, for example, even when a rotation speed of the fan 1 is low and the air flow rate in the gas flow passage 40 is small, the flow velocity of air can be increased and the negative pressure can be appropriately generated. Thus, the fuel gas outflow using the negative pressure can be appropriately performed from the fuel gas outlet 60, and combustible mixed gas obtained by mixing fuel gas and air at an appropriate ratio can be generated, thus increasing a turndown ratio.

On the other hand, although the first blade portion 6A and the second blade portion 6B are positioned in the gas flow passage 40 and extend in the y direction, the first blade portion 6A and the second blade portion 6B can have a configuration having a thin wall shape as described with reference to FIG. 4 and not causing a large resistance to the air flow. Thus, the pressure loss can also be reduced.

Figure 7:
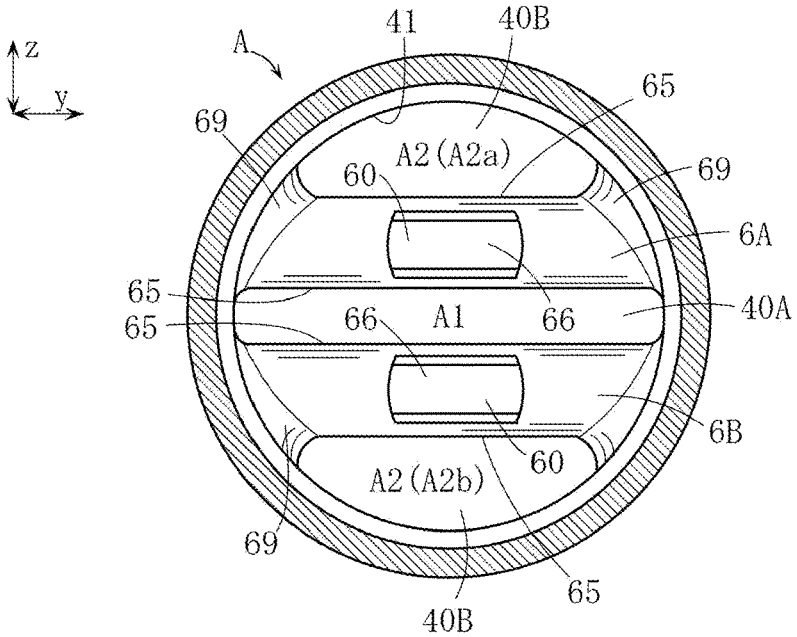
FIG. 7 is a cross-sectional view taken along a line VII-VII of FIG. 1.
Figure 8:
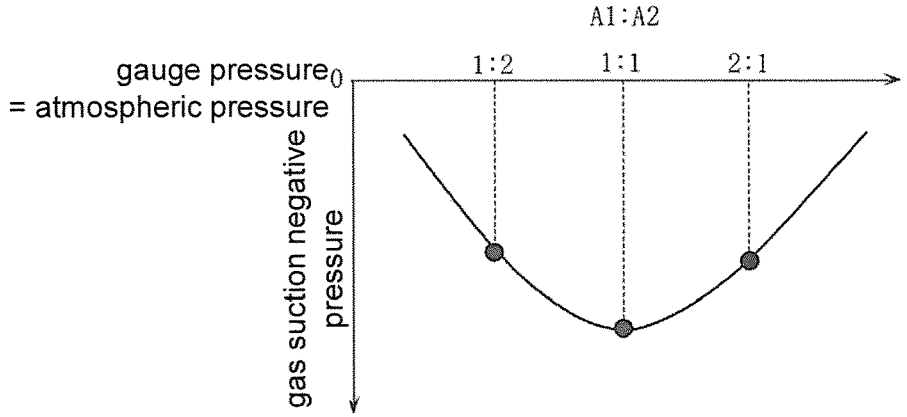
FIG. 8 is a graph showing a relationship between an area ratio of an air flow path near the center and air flow paths near the end and a suction negative pressure of fuel gas.

FIG. 8 shows suction negative pressures generated when a ratio of the flow path area A1 of the air flow path near the center 40A and the flow path area A2 of each air flow path near the end 40B described with reference to FIG. 7 is changed to 1:2, 1:1, and 2:1.

According to the data shown in FIG. 8, it is understood that the suction negative pressure can be made the lowest when the ratio of the flow path areas A1 and A2 is set to 1:1. This is presumed according to the fact that when the ratio is 1:1, air will not flow in a large biased amount respectively to the air flow path near the center 40A and each air flow path near the end 40B, and a Venturi effect can be efficiently obtained at each point of the air flow path near the center 40A and each air flow path near the end 40B.

On the other hand, in the premixing device A of the embodiment, as described above, the flow path areas A1 and A2 are set to be substantially equal, and the configuration is close to the 1:1 ratio described above. Thus, the suction negative pressure action of fuel gas due to the Venturi effect is enhanced, and the turndown ratio can be further increased.

An air vortex may occur in the vicinity of the first blade portion 6A and the second blade portion 6B on the downstream side in the gas flow direction. On the other hand, because the fuel gas outlet 60 is arranged in the concave portion 66 at the rear end portion of the first blade portion 6A and the second blade portion 6B, a vortex is less likely to act in the vicinity of the fuel gas outlet 60. Thus, the fuel gas outflow from the fuel gas outflow port 60 can be prevented from being obstructed by the vortex, and the fuel gas outflow can be smoothed. This also increases the turndown ratio.

The disclosure is not limited to the contents of the above-described embodiment. The specific configuration of each portion of the premixing device according to the disclosure and the combustion device equipped with the premixing device can be variously redesigned within the scope intended by the disclosure.

In the above-described embodiment, because the air flow path near the center 40A is squeezed using the inner bulging portion 65*a*, and additionally, each air flow path near the end 40B is squeezed using the outer bulging portion 65*b*, thus the negative pressure for fuel gas outflow is strengthened. However, the disclosure is not limited hereto. The disclosure can also have a configuration in which one of the air flow path near the center and the air flow path near the end is squeezed and the other is not squeezed. Even in this case, compared with Patent literature 1, the negative pressure for fuel gas outflow can be strengthened, and the action intended by the disclosure can be obtained. In addition, with respect to measures for squeezing the air flow path toward the center, both the first and second blade portions may not be equipped with an inner bulging portion, and a configuration can also be adopted in which only one of the first and second blade portions is equipped with an inner bulging portion.

In the disclosure, a configuration can also be adopted in which three or more blade portions are arranged. In this case, if at least two of the three or more blade portions are in the relationship of the first and second blade portions intended by the disclosure, the at least two blade portions are included in the technical scope of the disclosure.

In the above-described embodiment, the x and y directions referred to in the disclosure are the horizontal directions, and the z direction is the vertical height direction. However, the disclosure is not limited hereto. The x, y, and z directions can be set as directions different from those in the above-described embodiment, as long as they are in a relationship of intersecting each other.

The combustion device of the disclosure is not limited to use for the hot water supply device, and can also be used as, for example, a combustion device for other purposes such as heating, incineration, and the like. In addition, the combustion device according to the disclosure is not limited to the type in which combustion gas advances downward, and can also use a type in which the combustion gas advances, for example, upward.

What is claimed is:

1. A premixing device, comprising:

a gas flow passage forming member in which an x direction among x, y, and z directions that intersect each other is used as an axial length direction, and a Venturi-shaped gas flow passage into which air can flow in from an outside is formed inside the gas flow passage forming member;

a blade portion positioned in the gas flow passage and extending in the y direction; and a fuel gas outlet that is arranged in the blade portion, and is used for allowing fuel gas to flow out into the gas flow passage by an action of a negative pressure generated when air flowing into the gas flow passage passes through a periphery of the blade portion and mixing the fuel gas with the air, wherein the blade portion comprises first and second blade portions that are spaced apart from each other in the z direction, and an air flow path near a center of the gas flow passage through which a part of the air flows is formed between the first and second blade portions, wherein the first blade portion and the second blade portion are plate shapes, extending in the y direction and configured to be connected with an inner wall surface of the gas flow passage with an interval in the z direction, and ends of the first blade portion and the second blade portion are respectively connected to rounded portions oppositely disposed on the inner wall surfaces of the gas flow passage, and at least one of a pair of surfaces of the first and second blade portions facing each other is equipped with an inner bulging portion that bulges in the z direction so as to squeeze a part of the air flow path near the center of the gas flow passage, wherein the inner bulging portion is configured to extend in the y direction.

2. The premixing device according to claim 1, wherein the Venturi-shaped gas flow passage comprises an opening portion for air inflow, an upstream tapered region that has an inner diameter gradually decreasing toward a rear side of the upstream tapered region, a small-diameter portion that is connected to the rear side of the upstream tapered region and has a minimum inner diameter, and a downstream tapered region that is connected to a rear side of the small-diameter portion and has an inner diameter gradually expanding toward a rear side of the downstream tapered region; and the inner bulging portion is positioned in the small-diameter portion.

3. The premixing device according to claim 1, wherein a pair of air flow paths near ends of the gas flow passage through which the other part of the air flows is formed between the first and second blade portions and an inner wall surface of the gas flow passage; and each surface of the first and second blade portions that faces the inner wall surface is equipped with an outer bulging portion that bulges in the z direction so as to squeeze a part of each of the pair of air flow paths near the ends of the gas flow passage.

4. The premixing device according to claim 3, wherein a flow path area of a location of each of the pair of air flow paths near the ends of the gas flow passage squeezed by the outer bulging portion and a flow path area of a location of the air flow path near the center of the gas flow passage squeezed by the inner bulging portion are substantially the same.

5. The premixing device according to claim 3, wherein the Venturi-shaped gas flow passage comprises an opening portion for air inflow, an upstream tapered region that has an inner diameter gradually decreasing toward a rear side of the upstream tapered region, a small-diameter portion that is connected to the rear side of the upstream tapered region and has a minimum inner diameter, and a downstream tapered region that is connected to a rear side of the small-diameter portion and has an inner diameter gradually expanding toward a rear side of the downstream tapered region; and the outer bulging portion is positioned in the small-diameter portion.

6. The premixing device according to claim 3, wherein the first and second blade portions respectively comprise:

a pair of front inclined surfaces that is arranged in a region near a front on an upstream side in a gas flow direction, inclines in a backward expanding manner so that a blade thickness increases toward a downstream side in the gas flow direction, and the pair of front inclined surfaces has an acute intersection angle; and a pair of rear inclined surfaces that is arranged on a rear side of the pair of front inclined surfaces, inclines in a backward narrowing manner so that a blade thickness decreases toward the downstream side in the gas flow direction, and has an inclination angle smaller than the inclination angle of the pair of front inclined surfaces, wherein a boundary part between the pair of front inclined surfaces and the pair of rear inclined surfaces is a location having a maximum blade thickness, a part of the boundary part is the inner bulging portion, and the other part of the boundary part is the outer bulging portion.

7. The premixing device according to claim 1, wherein each of a rear end portion of the first and second blade portions is equipped with a concave portion that is partially recessed toward an upstream side in a gas flow direction, and the fuel gas outlet is arranged in the concave portion.

8. A combustion device, comprising the premixing device according to claim 1.

9. A premixing device, comprising:

a gas flow passage forming member in which an x direction among x, y, and z directions that intersect each other is used as an axial length direction, and a Venturi-shaped gas flow passage into which air can flow in from an outside is formed inside the gas flow passage forming member;

a blade portion positioned in the gas flow passage and extending in the y direction; and a fuel gas outlet that is arranged in the blade portion, and is used for allowing fuel gas to flow out into the gas flow passage by an action of a negative pressure generated when air flowing into the gas flow passage passes through a periphery of the blade portion and mixing the fuel gas with the air, wherein the blade portion comprises first and second blade portions that are spaced apart from each other in the z direction, and a pair of air flow paths near ends of the gas flow passage through which a part of the air flows is formed between the first and second blade portion and an inner wall surface of the gas flow passage, wherein the first blade portion and the second blade portion are plate shapes, extending in the y direction and configured to be connected with the inner wall surface of the gas flow passage with an interval in the z direction, and ends of the first blade portion and the second blade portion are respectively connected to rounded portions oppositely disposed on the inner wall surfaces of the gas flow passage, and each surface of the first and second blade portions that faces the inner wall surface is equipped with an outer bulging portion that bulges in the z direction so as to squeeze a part of each of the pair of air flow paths near the ends of the gas flow passage, at least one of a pair of surfaces of the first and second blade portions facing each other is equipped with an inner bulging portion that bulges in the z direction so as to squeeze a part of the air flow path near the center of the gas flow passage, wherein the inner bulging portion is configured to extend in the y direction.

10. The premixing device according to claim 9, wherein the Venturi-shaped gas flow passage comprises an opening portion for air inflow, an upstream tapered region that has an inner diameter gradually decreasing toward a rear side of the upstream tapered region, a small-diameter portion that is connected to the rear side of the upstream tapered region and has a minimum inner diameter, and a downstream tapered region that is connected to a rear side of the small-diameter portion and has the inner diameter gradually expanding toward a rear side of the downstream tapered region; and the outer bulging portion is positioned in the small-diameter portion.

11. A combustion device, comprising the premixing device according to claim 9.

* * * * *